US007666127B2

(12) United States Patent
Sheets

(10) Patent No.: US 7,666,127 B2
(45) Date of Patent: Feb. 23, 2010

(54) ABLITERATOR: ABDOMEN, OBLIQUES EXERCISE MACHINE WITH CRUNCH COMPONENT

(76) Inventor: Tood R. Sheets, 22992 Tiagua, Mission Viejo, CA (US) 92692-1401

( * ) Notice: Subject to any disclaimer, the term of this patent is extended or adjusted under 35 U.S.C. 154(b) by 0 days.

(21) Appl. No.: 12/344,471

(22) Filed: Dec. 27, 2008

(65) Prior Publication Data

US 2009/0105051 A1 Apr. 23, 2009

Related U.S. Application Data

(63) Continuation-in-part of application No. 11/436,911, filed on May 18, 2006, now Pat. No. 7,494,454.

(51) Int. Cl.
*A63B 22/14* (2006.01)

(52) U.S. Cl. ..... 482/146; 482/140; 482/34

(58) Field of Classification Search ..... 482/34, 482/146–147, 79–80, 70–71, 140–142
See application file for complete search history.

(56) References Cited

U.S. PATENT DOCUMENTS 7,494,454 B2 * 2/2009 Sheets ..... 482/140

* cited by examiner

*Primary Examiner*—Lori Baker
(74) *Attorney, Agent, or Firm*—Law Office of J. Shedd; Jill Shedd

(57) ABSTRACT

The exercise apparatus targets the muscles around the abdominal, oblique muscles and mid-section of the body. An individual stands upon a platform and grasps a pair of handlebars positioned at waist height. The handlebars are attached to the top of a riser that extends downwards and is attached to a pair of rotating pivot arms. The riser also has a resistance mechanism that allows for compression of the riser in a downward movement. The pivot arms are attached to the center of a resistance device. An individual stands upon the apparatus, and while keeping the lower body relatively stationary, rotates the handlebars from side to side up to 220 degrees of rotation. An individual can also perform abdominal crunches by bending at the waist and pushing the riser downwards against the resistance of the abdominal crunch mechanism, and thus perform abdominal crunches throughout the entire rotation of the exercise apparatus.

16 Claims, 4 Drawing Sheets

ABLITERATOR: ABDOMEN, OBLIQUES EXERCISE MACHINE WITH CRUNCH COMPONENT

CROSS REFERENCE TO RELATED U.S. APPLICATION DATA

This application is a continuation-in-part of, and claims priority to, application Ser. No. 11/436,911 filed on May 18, 2006 the contents of which are hereby incorporated by reference.

BACKGROUND OF THE INVENTION

1. Field of Invention

This invention relates generally to an exercise machine and method of use that primarily targets the abdominal and mid-torso muscles of an individual, but also serves to strengthen the entire body as well as provide a cardiovascular/aerobic workout.

2. Background

This invention was designed to tone the core midsection muscles of a human body. In addition, the machine works the entire body both, strengthening the majority of the muscles and aerobically working the heart muscle.

The primary muscle groups that this invention isotonically targets on the anterior portion of a human body are the a) oblique abdominis muscles ("lovehandles"); b) rectus abdominis Muscles; c) biceps brachii muscles; and the d) pectoralis muscles. The primary muscle groups that this invention isotonically targets on the posterior portion of a human body are the a) erector spinae muscles; b) latissimus dorsi muscles and c) triceps brachii Muscles.

The primary muscle groups that this invention isometrically targets on the anterior portion of the human body are the quadriceps femoris muscles. The primary muscle groups that the invention isometrically targets on the posterior portion of the human body are the a) gluteal muscles (muscles that comprise the buttocks and allow a person to remain in an erect posture); and b) biceps femoris muscles (muscles on the back of the upper leg that enable a leg to bend).

The machine can be used by anyone, young or old, in shape or not, male or female. The resistance is only as difficult or easy as an individual desires, and thus it is safe for everyone. An individual does not have to lie supine or kneel. For some people it is very difficult for them to kneel or lie supine due to arthritis, knee injury, obesity, etc. With this invention an individual only has to be able to stand and grasp a handle and rotate clockwise and counterclockwise by keeping the lower body stationary and by rotating the upper body from the pelvic area. An added component is the ability to perform abdominal crunches by bending at the waist and pushing the handlebars downwards against the vertical abdominal crunch mechanism. An individual can do abdominal crunches throughout the entire rotation of the vertical riser and handlebars about the machine, thus targeting all core muscles in the midsection.

DESCRIPTION OF RELATED ART

There is a plethora of exercise apparatus and methods of exercising that already exist. The core area of the human body (as defined by the oblique abdominis muscles, the rectus abdominis muscles and the erector spinae muscles) is, however, one area which is difficult for many individuals to exercise to tone muscles and reduce fat.

Many of the exercise apparatuses that exist focus on the strengthening or toning aspects of the core region. The ongoing problem with the existing exercise apparatuses that focus on the core body is twofold. First, as is well known in the health field, the physical fitness field and in the nutrition field an individual cannot "spot reduce" fat from any part of the body and that well know fact is especially true of the core area, or lovehandle area. The only way to reduce fat is to either reduce calorie intake and/or to promote aerobic activity. Most of the extant exercise apparatuses focus solely on strengthening the core muscles and thus do not address the need to reduce fat through aerobic exercise.

For example, U.S. Pat. No. 6,669,610 claims a method and apparatus for exercising internal and external oblique muscles by utilizing lateral forces generated by the feet while maintaining the upper body in a fixed position to facilitate exercise of the oblique muscles. The U.S. Pat. No. 6,669,610 patent targets the oblique muscles but neglects to take an aerobic workout into consideration. The present invention is patently distinct in a number of ways. First, in order to provide an aerobic workout and to further increase the strengthening benefit the present invention has an active resistance mechanism rather than using the passive weight of an individual's own body. Second, the present invention provides varying levels of resistance based on the active resistance mechanism used, and through the use of a variable resistance magnet. Third, in the present invention an individual's lower limbs are optionally stabilized while the upper body does the work—which is very different from other prior art. This means that not only are the abdomen and oblique muscles exercised, but the entire upper body muscles are also exercised as well (such as the biceps, triceps, latissimus dorsi, and pectoralis muscles). Fourth, because the lower limbs are held in a stable position while rotating the upper body the lower limbs and muscles are working and thus a complete aerobic workout is had. Beyond these distinctions there are many other differences that one skilled in the art can easily see by reading the specification below.

Thus, what is desired is a safe, yet effective, aerobic and muscle strengthening apparatus and method of use so that an individual can achieve both an aerobic workout while toning the core muscles of the body.

OBJECTS OF THE PRESENT INVENTION

Based on the background, long felt need and lack of an apparatus in the related art to address that long felt need, the following objects of the present invention are discussed.

It is an object of the present invention to provide an apparatus that an individual may employ while in an upright standing position to exercise the "core" muscles, as well as providing an aerobic workout, by using a low impact resistance based method.

It is a further object of the present invention to allow an individual to perform exercises used to primarily isolate the oblique abdominis muscles ("lovehandles"), the rectus abdominis muscles, and the erector spinae muscles It is another object of the present invention to allow an individual to perform exercises used to primarily isolate the rectus abdominis muscles and the erector spinae muscles by performing abdominal crunches through a wide variety of rotational positions.

It is an additional object of the present invention to provide an apparatus that an individual may employ to release vertebral fixations and loosen tight back muscles in a chiropractic fashion by rotating the upper body from the pelvic area while keeping the lower body stationary.

It is yet another object of the present invention to provide an adjustable height for the handlebars to accommodate different heights of individuals and to allow an individual to achieve a comfortable grasp of the handlebars while exercising.

It is a further object of the present invention to provide an apparatus and method of use that is safe for most every individual, despite most any physical limitation said individual may have, or regardless of the fitness level of any one particular individual.

It is a further object of the present invention to provide a method for adjusting the amount of resistance experienced by an individual while exercising without forcing an individual to stop or change position.

It is an additional object of the present invention to have as few moving parts and minimal wear as possible.

It is a further object of the present invention to provide a means to move the machine with minimal effort and to allow a method of storing the machine while not in use.

These and other objects and advantages of the present invention will be apparent from the following specification and accompanying drawings.

SUMMARY OF THE INVENTION

With the foregoing background in mind, it is the objective of the present invention to create an exercise apparatus and method for use. This exercise apparatus or exercise machine lies horizontally along the floor and is for use in a standing position. An individual, while grasping a pair of handle bars, rotates his or her body from the pelvic area upwards while maintaining a forward stable stance from the pelvic area downwards. This movement, in turn, moves the handlebars from side to side which moves a vertical riser comprised of a vertical abdominal crunch mechanism. The vertical abdominal crunch mechanism moves the pivot arms in a lateral motion, with said pivot arms being attached to the rotational resistance mechanism. In addition to the upright rotational movement described above an individual can also perform abdominal crunches by bending at the waist and pushing the handlebars downwards against the resistance of the vertical abdominal crunch mechanism. An individual can perform the abdominal crunch action through the full rotational movement of the exercise apparatus. An individual can adjust the pressure, and thus the resistance, in vertical abdominal crunch mechanism by means of an attached pump and release valve. These two actions, the rotational movement and abdominal crunch movement, provide significant use of mid and torso muscle groups and helps to exercise the waist, hips, and stomach areas of the body as well as many other major muscles, including the heart.

The present invention provides a machine that an individual stands upon while grasping a pair of handlebars distally mounted to a rigid vertical riser, which pivots from side to side of the machine up to 220 degrees of arc. The present invention further comprises of an attached resistance mechanism that is rotated in either direction by the attached vertical riser and handlebars and provides dynamic resistances in each direction as an individual moves the handlebars. This resistance increases at the beginning and end of each motion thus creating a bi-directional use of various muscle groups. The variable rotational resistance can be adjusted from a lever mounted just below the handlebars while exercising to increase or decrease the level of effort needed to suit an individual's preferences.

DETAILED DESCRIPTION OF THE PREFERRED EMBODIMENT

Figure 1:
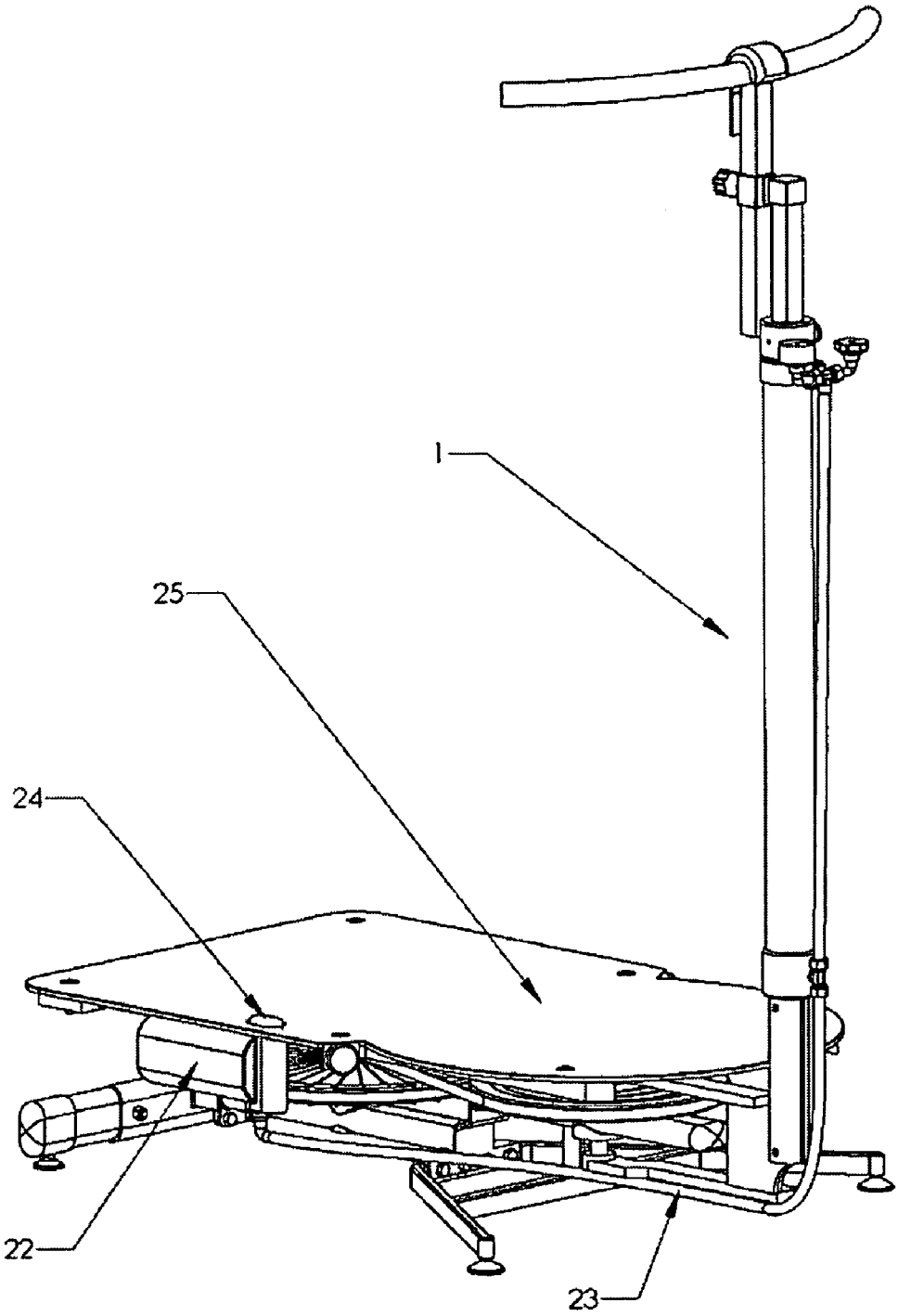
FIG. 1 is an isometric perspective view of the preferred embodiment depicting many of the major components of the present invention.

The terminology used herein should be interpreted in its broadest reasonable manner, even though it is being utilized in conjunction with a detailed description of a certain specific preferred embodiment of the present invention. This is further emphasized below with respect to some particular terms used herein. Any terminology that the reader should interpret in any restricted manner will be overtly and specifically defined as such in this specification. The preferred embodiment of the present invention will now be described with reference to the accompanying drawings, wherein like reference characters designate like or similar parts throughout.

Referring to FIGS. 1, 2, 3, 4 and 5 the vertical abdominal crunch mechanism 1 of the present invention will now be described in detail. The main components of the present invention and preferred embodiment are generally described as being comprised of a handlebar 2, rubber handlebar pad 3, height adjustment engagement lock 4, adjustable handle bar post 5, handlebar post attachment brace 6, vertical riser post 7, bushing retainer cap 8, pressure release restrictor valve 9, vertical riser tube 10, abdominal crunch mechanism attachment brace 11, pressure inlet and riser T fitting 29, flexible pressure hose 23, battery powered abdominal crunch resistance pump 22, battery powered abdominal crunch resistance pump activation button 24, an abdominal crunch resistance measurement gauge 27, an abdominal crunch resistance release valve 26 and an abdominal crunch resistance measurement tube 28.

Figure 3:
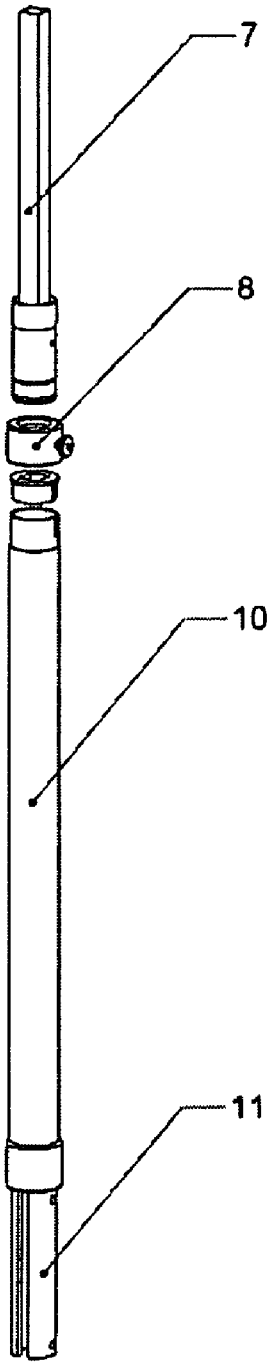
FIG. 3 is an isometric perspective close up view of the major pieces of the abdominal crunch mechanism component.
Figure 4:
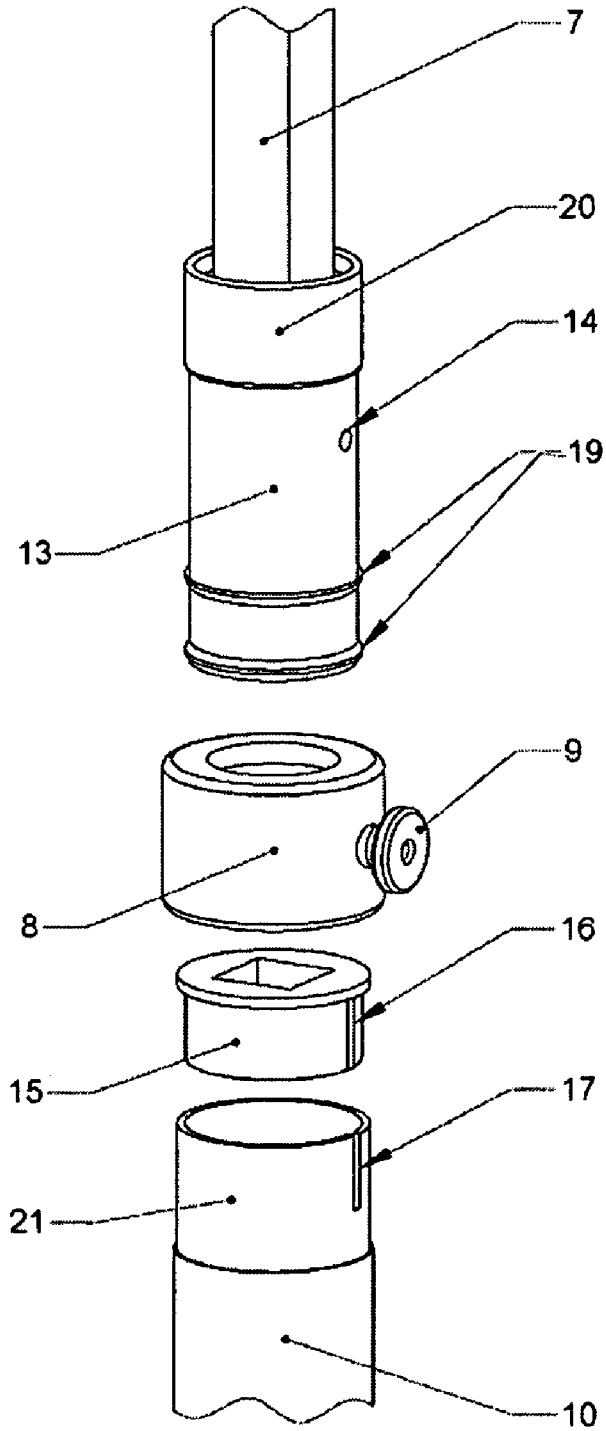
FIG. 4 is a component by component close-up view of the top end of the abdominal crunch mechanism component.

With further reference to FIG. 3 and FIG. 4 the preferred embodiment of the vertical abdominal crunch mechanism 1 is comprised of three major components. The first is the vertical riser tube 10. The vertical riser tube 10 is basically cylindrical in shape and is the receptacle that contains the resistance fluid, in the preferred embodiment the preferred fluid is air pressure, which in turn provides the resistance to the individual performing an abdominal crunch. The second major component is the vertical riser post 7. This vertical riser post 7 is attached at its upper end to the handlebar post attachment brace 6 and at its lower end it is affixed to the third major component, the vertical riser post piston 13, by way of a retaining pin 14. The vertical riser post piston 13 has two vertical riser post piston seals 19 wherein one of the vertical riser post piston seals 19 is on the bottom of the vertical riser post piston 13 and the second vertical riser post spacer seal 19 is placed a distance up the vertical riser post piston 13 for maximum sealing ability in both direction. The vertical riser post piston 13 slides into the vertical riser tube 10 and compresses the extant fluid in the vertical riser tube 10 in proportion to the amount of force being exerted by an individual performing an abdominal crunch.

The vertical riser post guide bushing 15 is affixed to the top of the vertical riser tube 10 and serves as both a stop for the vertical riser post piston 13 and as a means to prevent rotation of the vertical riser post 7 inside the vertical riser tube 10. The vertical riser post guide bushing 15 has a round outside shape and a rectangular inner cutout in which the vertical riser post 7 is positioned. Since the vertical riser post 7 is attached to the handlebar post attachment brace 6 the vertical riser post guide bushing 15 employs a vertical riser post guide bushing alignment key 16 which is then mated with the vertical riser tube bushing alignment slot 17 contained on the vertical riser tube 10 so that the vertical riser post 7 can not rotate inside the vertical riser tube 10. In addition to preventing rotation of the vertical riser post 7, the vertical riser post guide bushing's 15 outside diameter is greater than the inside diameter of the vertical riser tube 10 thus creating a lip so that the vertical riser post piston 13 and the vertical riser post piston stop 20 is blocked from pushing past the top of the vertical riser tube 10. To hold the vertical riser post guide bushing 15 firmly in place a bushing retaining cap 8 is slid over the vertical riser post 7 and fastens the vertical riser post guide bushing 15 to the vertical riser tube 10 at the vertical riser tube bushing retainer cap thread 21 portion of the vertical riser tube 10.

Figure 2:
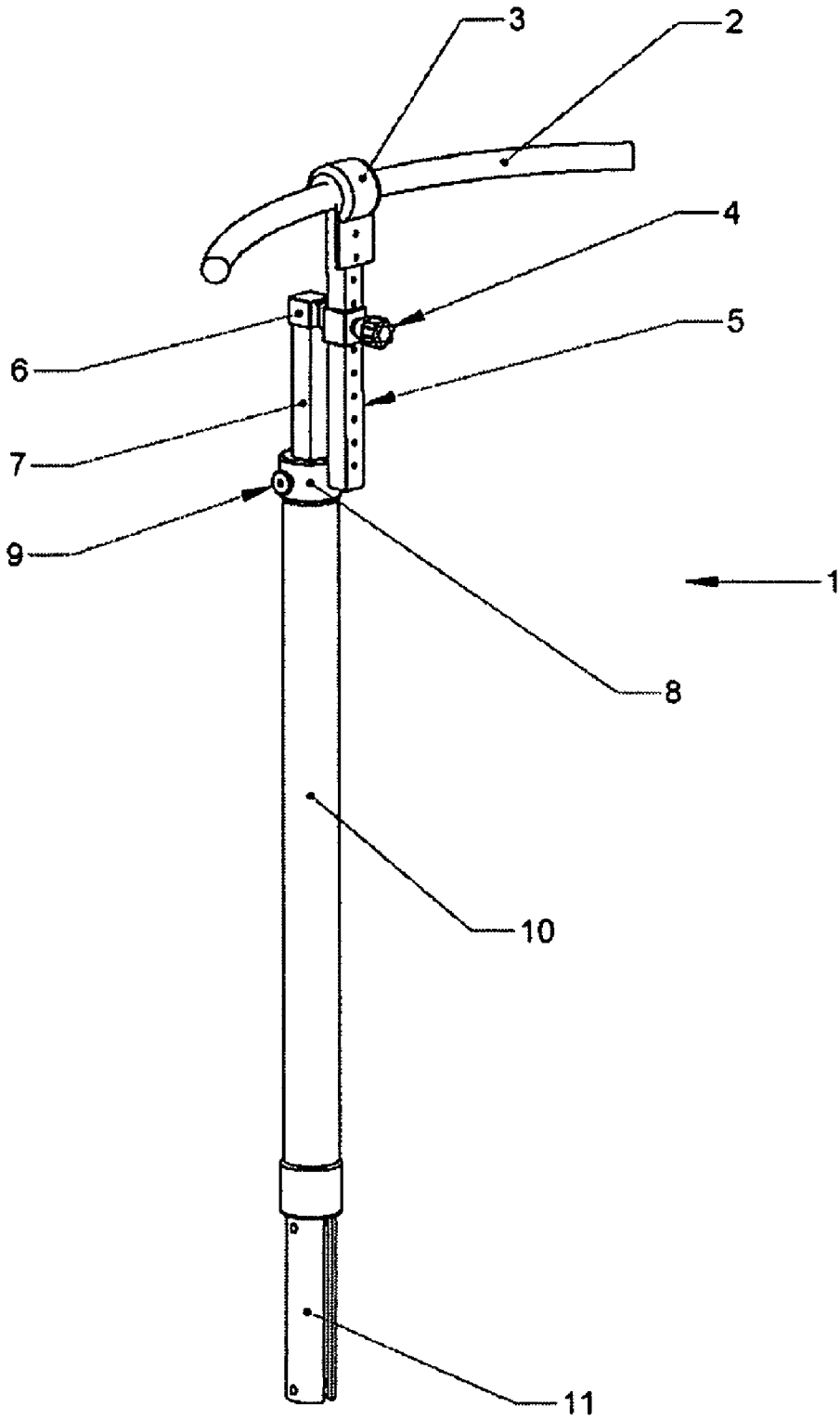
FIG. 2 is an isometric perspective close up near side view of the fully assembled handlebar and abdominal crunch air based resistance mechanism component.

FIG. 2 depicts how the abdominal crunch mechanism 1 attaches to the handlebar 2 on one end and to the rotational resistance mechanism on the other end. Specifically, the vertical riser post 7 is attached to an adjustable handlebar post 5 via a handlebar post attachment brace 6. The handlebar 2 is attached to the adjustable handlebar post 5 at the adjustable handlebar post's 5 upper end. The adjustable handlebar post 5 has predrilled holes in it that are used to adjust the height of the handlebar 2. The handlebar 2 is adjustable in the vertical direction by moving the adjustable handlebar post 5 upwards or downwards, depending on the individual's height and comfort zone, and locking the adjustable handlebar post 5, and thus the handlebar 2, into place using the height adjustment engagement lock 4 piercing the holes in the adjustable handlebar post and into the handlebar post attachment brace 6. In addition, a rubber handlebar pad 3 is affixed at the junction of the adjustable handlebar post 5 and the handlebars 2. The purpose of the rubber handlebar pad 3 is to give an individual a comfortable and slip resistance surface on which to bend against while compressing the vertical abdominal crunch mechanism 1. On the bottom of the abdominal crunch mechanism is an abdominal crunch mechanism attachment brace 11 which is affixed to the pivot arms that lie under the standing platform and attach to the rotational resistance mechanism as described in the parent application.

Figure 5:
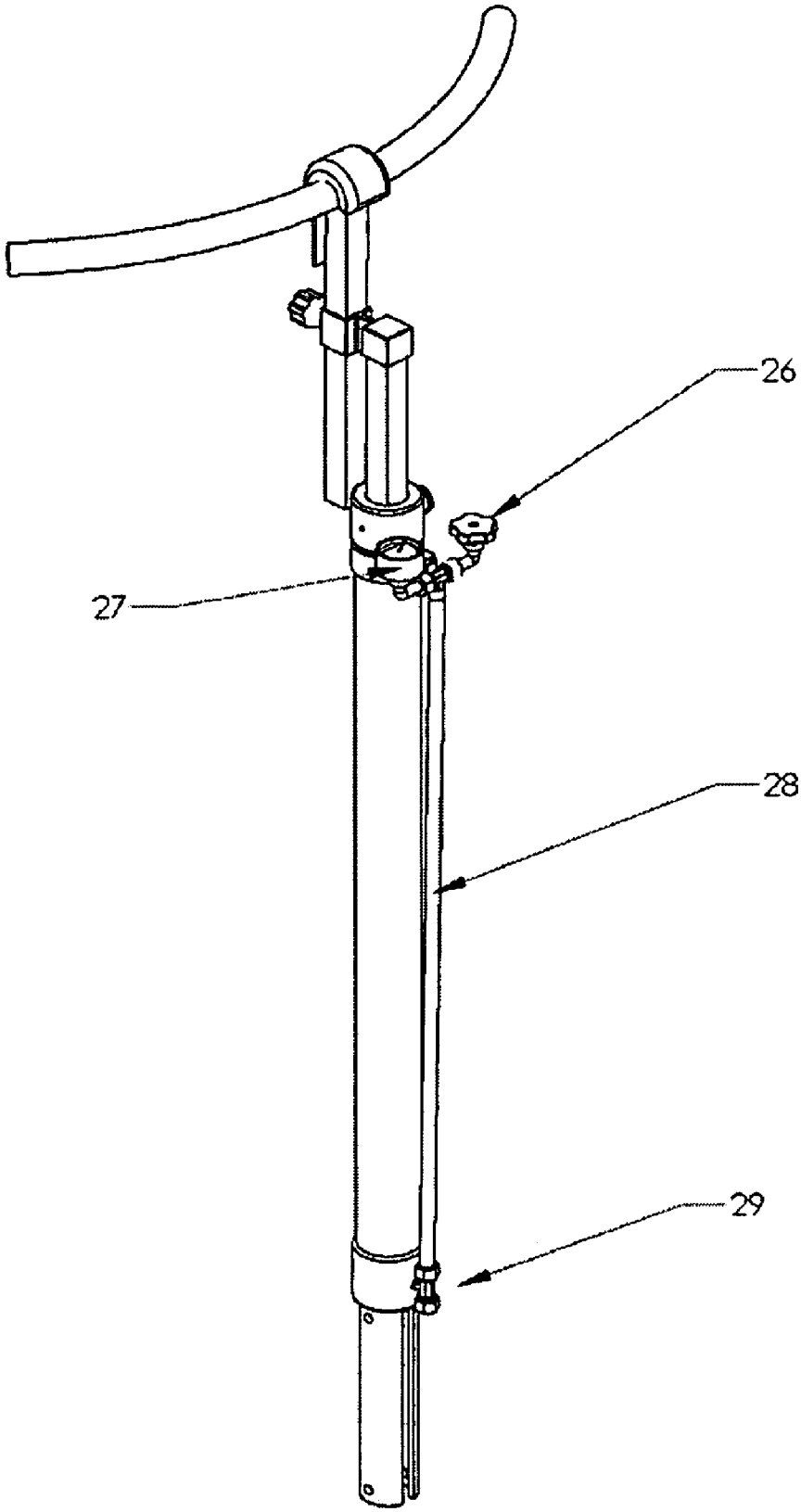
FIG. 5 is an isometric perspective close up far side view of the fully assembled handlebar and abdominal crunch mechanism component including the resistance measuring device and the means of adding or subtracting resistance to the abdominal crunch mechanism.

Referring to FIG. 1 and FIG. 5 mechanisms are shown that allow an individual using the exercise apparatus to adjust the abdominal crunch resistance and to monitor the resistance for each exercise session. One of the mechanisms allows an individual to increase the resistance by increasing the volume of fluid in the vertical riser tube 10 by means of a battery powered abdominal crunch resistance pump 22. The battery powered abdominal crunch resistance pump 22 is located on the obverse side of the standing platform 25 of the exercise apparatus and is activated by a resistance pump activation button 24 that is exposed from the battery powered abdominal crunch resistance pump 22 through the standing platform 25 so that an individual can activate the battery powered abdominal crunch resistance pump 22 by simply moving his or her foot to the side of the standing platform 25 and pressing down on the resistance pump activation button 24. The battery powered abdominal crunch resistance pump 22 is connected to the pressure inlet and riser T fitting 29 by means of a flexible hose 23 which is affixed to the underneath of the standing platform 25.

In addition to the battery powered abdominal crunch resistance pump 22 an abdominal crunch resistance release valve 26 and an abdominal crunch resistance measurement gauge 27 are provided. Both the abdominal crunch resistance release valve 26 and the abdominal crunch resistance measurement gauge 27 are connected to the actual fluid resistance in the vertical riser tube 10 by means of an abdominal crunch resistance measurement air tube 28. The abdominal crunch resistance measurement gauge 27 allows an individual to measure how much resistance is in the vertical abdominal crunch mechanism 1 at any given time and thus allows an individual the ability to monitor his/her progress by noting the resistance for each exercise session. Conversely, the abdominal crunch resistance release valve 26 allows an individual the ability to decrease the resistance by releasing some of the fluid pressure contained in the abdominal crunch mechanism 1.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, the description contained in this specification is to be considered exemplary, rather than limiting, and the true scope of the invention is only limited by the following claims and any equivalents thereof.

What is claimed is:

1. An exercise apparatus for exercising the rectus abdominis muscles, oblique abdominis muscles and erector spinae muscles, while providing an aerobic workout, allowing an individual to stand upright on the exercise apparatus, the exercise apparatus comprising:

a. a handlebar further comprising a first handle extending outwardly and horizontally from a center point to receive the right hand of an individual using the exercise apparatus and a second handle extending outwardly and horizontally from the opposite side of said center point to receive the left hand of an individual using said exercise apparatus whereby said handlebar is positionable in front of an individual and configured to be held by each of an individual's hands;

b. a vertical abdominal crunch mechanism connected distally to said horizontal handlebar center point said vertical abdominal crunch mechanism extends downwardly therefrom;

c. wherein said abdominal crunch mechanism offers variable resistance to an individual in the vertical plane;

d. a standing platform where an individual stands with a stationary stance to grasp said handlebars;

e. a rotational resistance mechanism;

f. pivot arms that are affixedly attached via the anterior portion of said pivot arms to said vertical abdominal crunch mechanism and at the posterior part to said rotational resistance mechanism, said pivot arms being capable of being rotated, and hence rotating said vertical abdominal crunch mechanism, in an arc of at least 220 degrees;

g. a main chassis that supports the resistance mechanism and the standing platform;

h. a lateral rear stand affixedly attached to the posterior portion of said main chassis and having a height to provide both ground clearance and stability to the posterior portion of said main chassis;

i. a lateral front stand affixedly attached to the mid section of said main chassis and extending forward having an equal height as said rear stand to provide both ground clearance and stability to the anterior portion of said main chassis;

j. and fasteners for attaching said standing platform to said main chassis.

2. A vertical abdominal crunch mechanism of claim 1 further comprising:

a. an adjustable handlebar post;

b. a vertical resistance apparatus affixedly attached to the adjustable handlebar post on the one end and to the vertical riser attachment brace on the other end.

3. An adjustable handlebar post of claim 2 further comprising:

a. an adjustable handlebar post with predrilled positioning holes along its front length;

b. a handlebar post attachment brace;

c. said adjustable handlebar post being positioned by sliding said adjustable handlebar post upwards or downwards through said handlebar post attachment brace;

d. a handlebar adjustment engagement lock wherein said handlebar adjustment engagement lock secures said adjustable handlebar post at a desired vertical position that is a comfortable height for each individual by securing the adjustable handlebar post positioning holes to the handlebar post attachment brace.

4. A vertical resistance apparatus of claim 2 further comprising:

a. a cylindrical vertical riser tube containing a fluid under pressure;

b. a vertical riser post piston that acts upon the fluid under pressure by compressing or decompressing said fluid;

c. a rectangular vertical riser post that is affixed at one end to an adjustable handlebar post by a handlebar post attachment brace and at another end to a vertical riser post piston;

d. vertical riser post piston seals affixed to said vertical riser post piston wherein at least one seal is affixed towards the bottom of said vertical riser post piston and at least one other vertical riser post piston seal is placed a sufficient distance apart so as to provide sealing ability in both the downs and upstroke directions;

e. wherein the vertical riser post affixedly attached to the vertical riser post piston slides into the vertical riser tube;

f. a stopping mechanism so that the vertical riser post and vertical riser post piston are prevented from rotating around a center axis.

5. The stopping mechanism of claim 4 further comprising:

a. a circular post guide bushing wherein the guide bushing has an upper lip that has an outside diameter greater than the inside diameter of the vertical riser tube and a rectangular inner cutout that can accommodate the rectangular vertical riser post;

b. a bushing alignment key that is extruded outwardly from the side of said guide bushing;

c. a riser tube thread at the top of the vertical riser tube;

d. a bushing alignment slot wherein said slot is the depth of the wall of the riser tube and is placed at the top of the riser tub in the riser tube thread section;

e. wherein the bushing alignment key mates to the bushing alignment slot so as to prevent rotation of the vertical riser post and adjustable handlebar;

f. wherein the rectangular vertical riser tube is captured laterally through the rectangular inner cutout of said post guide bushing;

g. wherein the guide bushing's base acts as a vertical stop for the vertical riser post piston;

h. wherein a bushing retainer cap is threaded onto the end of the riser post, via the riser tube thread, capturing the post guide bushing.

6. A vertical riser tube of claim 4 wherein the resistance is from the compression of a gas inside the vertical riser tube.

7. A vertical riser tube of claim 4 wherein the resistance is from the compression of a viscous fluid.

8. An exercise apparatus of claim 1 further comprising:

a. an apparatus for measuring the resistance of the abdominal crunch mechanism dynamically using a fluid pressure;

b. an apparatus for increasing the resistance of the abdominal crunch mechanism dynamically using a fluid pressure;

c. and an apparatus for decreasing the resistance of the abdominal crunch mechanism dynamically using a fluid pressure.

9. An apparatus for dynamically measuring the resistance of claim 8 further comprising a pressure gauge affixed to the abdominal crunch mechanism which measures the fluid pressure contained therein.

10. An apparatus for dynamically increasing the resistance of claim 8 further comprising a pump which increases the fluid pressure via into the abdominal crunch mechanism wherein said pump is activated by a button accessible by the user.

11. A button accessible by the use of claim 10 wherein the button is mounted near the foot of the user.

12. A pump of claim 10 wherein the fluid is a gas air and the pump increases the amount of gas pressure in the abdominal crunch mechanism.

13. An apparatus for dynamically decreasing the resistance of claim 8 further comprising a release valve affixedly attached to abdominal crunch mechanism wherein a user can turn the valve to relieve the fluid pressure in the abdominal crunch mechanism.

14. A method of increasing the resistance in the vertical abdominal crunch mechanism of claim 10, comprising the steps of activating the button to engage the pump.

15. A method of decreasing the resistance in the vertical abdominal crunch mechanism of the exercise machine of claim 10, comprising the steps of turning the release valve to a more open position so as to release the pressure contained in the abdominal crunch mechanism.

16. A method of using the abdominal crunch mechanism of claim 1 comprising the steps of:

a. mounting said standing platform;

b. setting the handlebar to the desired height;

c. grasping the terminal ends of said handlebar mechanism;

d. keeping the lower body relatively stationary;

e. bending at the waist by leaning against the handlebar thereby compressing the abdominal crunch mechanism;

f. wherein the bending motion can be done at any position in the 220 degree arc.

* * * * *